US010050376B2

(12) United States Patent
Suzuki et al.

(10) Patent No.: US 10,050,376 B2
(45) Date of Patent: Aug. 14, 2018

(54) CONNECTOR

(71) Applicant: YAZAKI CORPORATION, Tokyo (JP)

(72) Inventors: Shogo Suzuki, Shizuoka (JP); Kenichi Kawashima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/791,305

(22) Filed: Oct. 23, 2017

(65) Prior Publication Data

US 2018/0115104 A1 Apr. 26, 2018

(30) Foreign Application Priority Data

Oct. 25, 2016 (JP) ..... 2016-208735

(51) Int. Cl.
*H01R 13/52* (2006.01)
*H01R 13/516* (2006.01)
*H01R 107/00* (2006.01)

(52) U.S. Cl.
CPC ..... *H01R 13/5219* (2013.01); *H01R 13/516* (2013.01); *H01R 13/5216* (2013.01); *H01R 2107/00* (2013.01); *H01R 2201/26* (2013.01)

(58) Field of Classification Search
CPC ..... H01R 13/5216; H01R 13/516; H01R 2107/00; H01R 2201/26; H01R 13/5202; H01R 13/52
USPC ..... 439/271, 587, 588
See application file for complete search history.

(56) References Cited

U.S. PATENT DOCUMENTS 4,874,325 A * 10/1989 Bensing ..... H01R 13/5219 439/272
7,104,840 B2 * 9/2006 Murakami ..... H01R 13/6277 439/272
2004/0110419 A1 * 6/2004 Nishida ..... H01R 13/5219 439/587
2009/0286412 A1 * 11/2009 Ikeda ..... A61B 1/00128 439/271

FOREIGN PATENT DOCUMENTS

JP 2014-96264 A 5/2014

* cited by examiner

*Primary Examiner* — Tulsidas C Patel
*Assistant Examiner* — Travis Chambers
(74) *Attorney, Agent, or Firm* — Kenealy Vaidya LLP

(57) ABSTRACT

According an aspect of the invention, a connector includes a housing that includes a fitting portion having an outer periphery to which a cylindrical counterpart fitting portion of a counterpart connector is loosely fitted, a ring-shaped packing that includes a main body that is formed of an elastic member and is externally inserted in a tightly fitted manner to the outer periphery of the fitting portion so as to water-tightly seal a space between the fitting portion and the counterpart fitting portion, a ring-shaped resin ring portion that is provided at a base end of the packing, is formed of resin having a higher rigidity than the main body, and is locked to an engagement portion provided in the housing, and a notch portion that is provided in a part of an inner periphery of the resin ring portion.

4 Claims, 17 Drawing Sheets

CONNECTOR

CROSS REFERENCE TO RELATED APPLICATION

This application is based on Japanese Patent Application No. 2016-208735 filed on Oct. 25, 2016, the contents of which are incorporated herein by reference.

BACKGROUND OF THE INVENTION

1. Technical Field

The present invention relates to a connector.

2. Background Art

For example, as a connector used in a vehicle such as an automobile, a connector including a housing and a packing that is formed in a ring shape and is mounted in the housing is known, in which the packing waterproofs a space between the packing and a counterpart connector (for example, refer to JP-A-2014-96264).

In the connector, the packing includes: a packing main body that has a ring shape and is formed of resin such as rubber; and a resin ring portion that protrudes in a ring shape from an outer peripheral surface at a base end of the packing main body and is formed of resin such as plastic having a higher rigidity than the packing main body.

When the packing is inserted into an outer periphery of a fitting portion of the housing, a locking protrusion that is formed in the resin ring portion and protrudes outwardly is locked to a locking arm that is an engagement portion of the housing. As a result, the packing is restricted from moving to a distal end side, and is assembled into the housing in a state where the packing is retained in the fitting portion.

However, in the connector including the packing in which the resin ring portion is provided at the base end of the packing main body in order to retain the packing in the fitting portion of the housing as described above, there may be a problem such as biting of the packing during fitting to a counterpart connector.

When the connector fitting work is completed in a state where the packing is bitten, the connector cannot satisfy waterproof performance may have a product defect. Therefore, in the connector in which the packing including the resin ring portion is assembled into the housing in the retained state, it is required to solve the problem such as biting of the packing and to secure more satisfactory waterproofness.

The present invention has been made in consideration of the above-described circumstances, and an object thereof is to provide a connector capable of solving a problem such as biting of a packing during fitting to another connector and securing more satisfactory waterproof performance without any change in the number of parts and configuration.

SUMMARY OF THE INVENTION

The object of the present invention can be achieved by the following configurations.

(1) According an aspect of the invention, a connector includes:

a housing that includes a fitting portion having an outer periphery to which a cylindrical counterpart fitting portion of a counterpart connector is loosely fitted;

a ring-shaped packing that includes a main body that is formed of an elastic member and is externally inserted in a tightly fitted manner to the outer periphery of the fitting portion so as to water-tightly seal a space between the fitting portion and the counterpart fitting portion;

a ring-shaped resin ring portion that is provided at a base end of the packing opposite to a distal end where the counterpart connector is fitted, so as to be integrated with an outer periphery of the main body, is formed of resin having a higher rigidity than the main body, and is locked to an engagement portion provided in the housing; and a notch portion that is provided in a part of an inner periphery of the resin ring portion.

In the connector having the configuration of (1), the notch portion is provided in a part of the resin ring portion that is locked to the engagement portion (locking arm) provided in the housing. As a result, the frame strength of the resin ring portion is weakened. In a case where the packing is mounted in the fitting portion of the housing, when the elastic member of the main body is compressed between the resin ring portion and the fitting portion, the notch portion extends due to the reaction force, and the resin ring portion extends (that is, the diameter thereof increases) in a direction opposite to a surface thereof tightly fitted to the fitting portion. As a result, the amount by which the elastic member of the main body is displaced from the space between the resin ring portion and the fitting portion to the distal end side is suppressed. Accordingly, the rising of the distal end side of the packing is prevented from occurring when the elastic member of the main body moves from the space between the resin ring portion and the fitting portion to the distal end side.

(2) In the connector of (1), the resin ring portion is formed in a polygonal ring shape, and the notch portion is formed in at least one internal corner portion of the resin ring portion.

In the connector having the configuration of (2), in the resin ring portion of the packing, the notch portion is provided in the internal corner portion of the polygon. As a result, the diameter of the resin ring portion can be effectively increased as compared to a case where the notch portion is provided in a side portion of the polygon.

(3) In the connector of (1) or (2), the distal end of the main body has smaller inner and outer diameters than other portions of the main body excluding the distal end and has a tapered thick portion that is formed to be thicker than the other portions.

In the connector having the configuration of (3), the tapered thick portion is provided at the distal end of the main body of the packing. As a result, in the main body, the rigidity of the distal end is higher than that of the other portions. By providing the tapered thick portion having high rigidity at the distal end, when the packing is mounted on the fitting portion of the housing, a force to tightly fit the packing to the fitting portion is increased. As a result, even when a part of the elastic member of the main body is displaced from the space between the resin ring portion and the fitting portion to the distal end side, the separation of the distal end side from the outer periphery of the fitting portion is restricted, and the tightly fitted state is maintained. Accordingly, the rising of the distal end side of the packing prevented from occurring when the elastic member of the main body moves from the space between the resin ring portion and the fitting portion to the distal end side.

In the connector according to the present invention, a problem such as biting of the packing during fitting to another connector can be solved, and waterproof performance can be secured without any change in the number of parts and configuration.

The present invention has been simply described. Further, the details of the present invention will become more apparent by reading through a mode for carrying out the present invention (hereinafter, referred to as an "embodiment") to be described below with reference to the accompanying drawings.

DETAILED DESCRIPTION OF EMBODIMENTS

Hereinafter, embodiments of the present invention will be described with reference to the drawings.

First Embodiment

Figure 1:
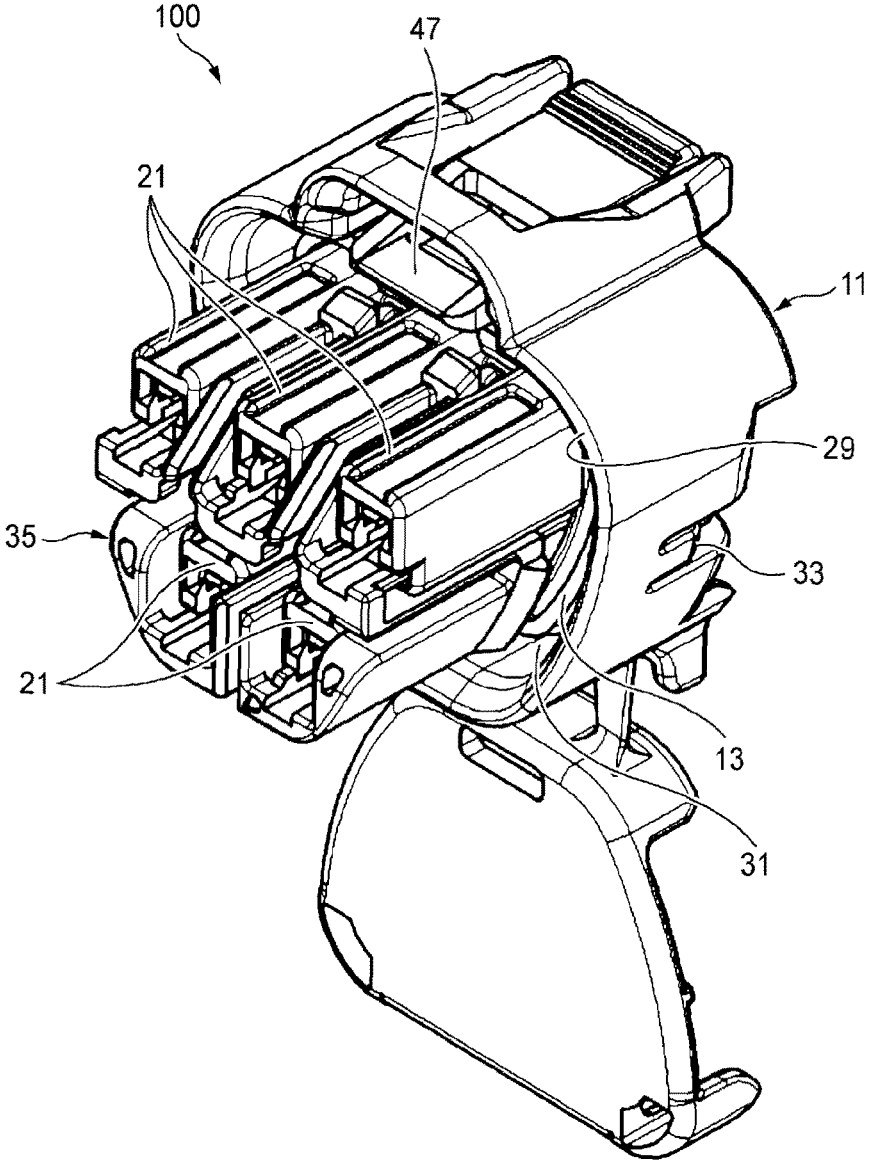
FIG. 1 is a perspective view illustrating a connector according to a first embodiment of the present invention.
Figure 2:
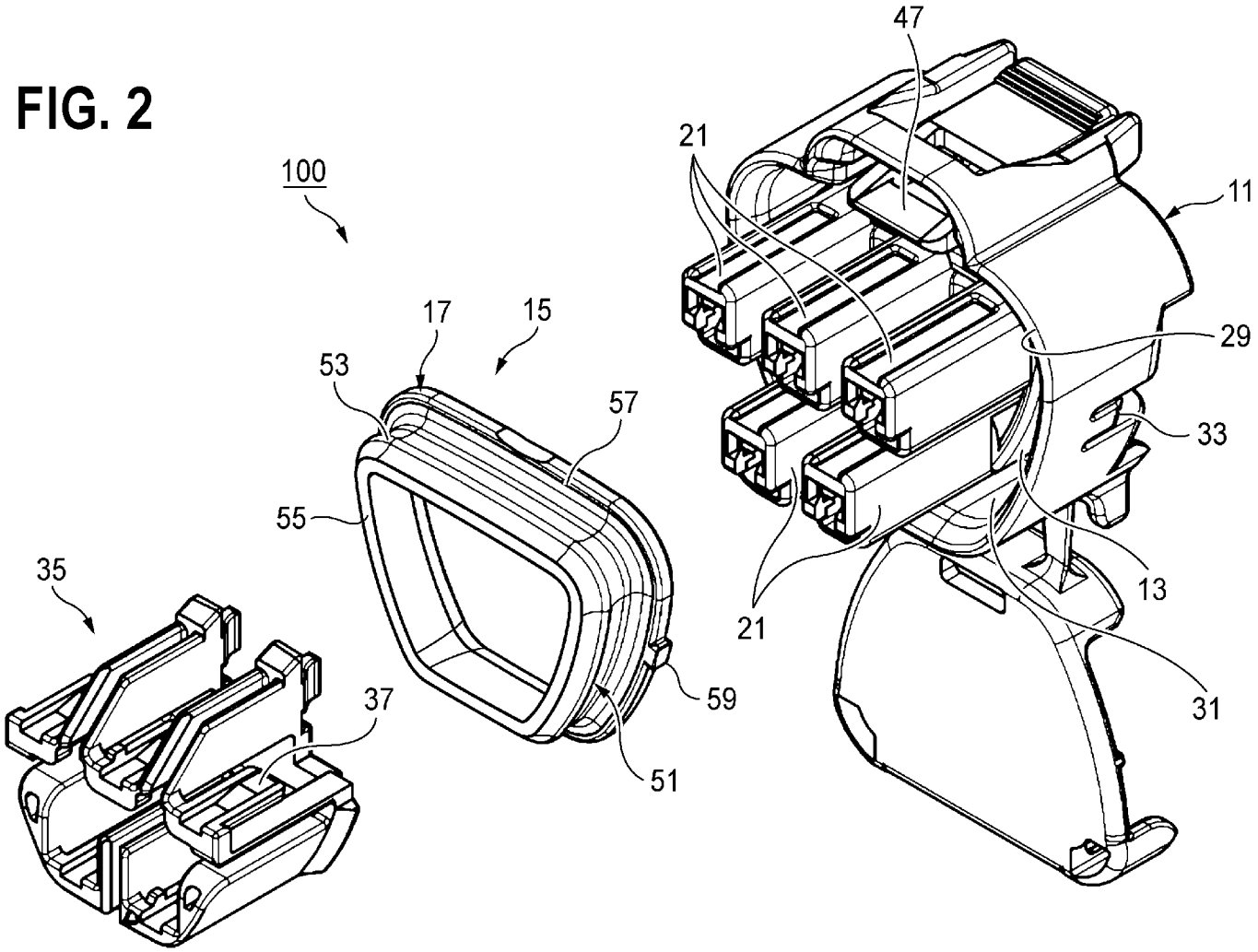
FIG. 2 is an exploded perspective view illustrating the connector illustrated in FIG. 1.

FIG. 1 is a perspective view illustrating a connector according to a first embodiment of the present invention, and FIG. 2 is an exploded perspective view illustrating the connector illustrated in FIG. 1. In this specification, a distal end side of a connector refers to a side where a counterpart connector is fitted.

A connector 100 according to the first embodiment can be used for, for example, a fuel tank of an automobile. The connector 100 provided in a wire harness of a floor mainly includes: a housing 11 that includes a fitting portion 13; and a packing 15 that is externally inserted to an outer periphery of the fitting portion 13.

The housing 11 is formed of, for example, resin such as plastic. This housing 11 includes the fitting portion 13 in which the outer periphery forms a cylindrical side surface. Plural terminal accommodation chambers 21 (in the embodiment, five) protrude from the fitting portion 13 to the distal end side.

In each of the terminal accommodation chambers 21, a cavity 23 (refer to FIG. 6) is formed. Terminals 25 are accommodated in the cavities 23. In the embodiment, the terminal 25 is a female terminal. The terminal 25 is restricted from falling off from the cavity 23 by being locked to a flexible locking piece 27 formed in the cavity 23. The terminal 25 is formed of a conductive metal material such as copper and is connected to an electric wire 26. The electric wire 26 connected to the terminals 25 is pulled out from a rear end side of the housing 11.

In the housing 11, the packing 15 is inserted from the distal end side of the housing 11 into a ring-shaped gap 31 that is formed between the cylindrical side surface of the fitting portion 13 and a housing outer cylinder portion 29.

In the housing 11, a flexible locking arm 33 that protrudes to the fitting portion 13 is formed in a rear-end center portion of opposite side portions in the vertical direction of the housing outer cylinder portion 29.

A spacer 35 is mounted on the distal end side of the housing 11. The spacer 35 includes restriction protrusions 37 corresponding to the respective terminal accommodation chambers 21. In the spacer 35 mounted in the housing 11, the restriction protrusion 37 is inserted into a retreat space of the flexible locking piece 27 (refer to FIG. 6) provided in each of the cavities 23. As a result, the terminal 25 is doublelocked such that the locking to the flexible locking piece 27 is restricted from being released.

Figure 3:
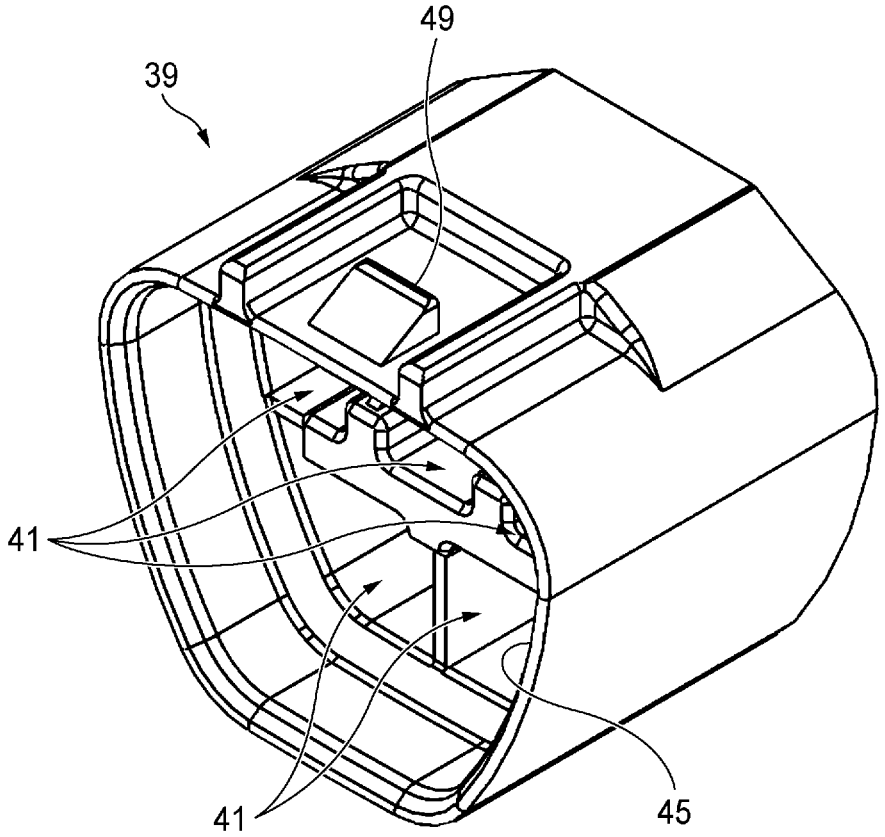
FIG. 3 is a perspective view illustrating a counterpart connector.
Figure 4A:
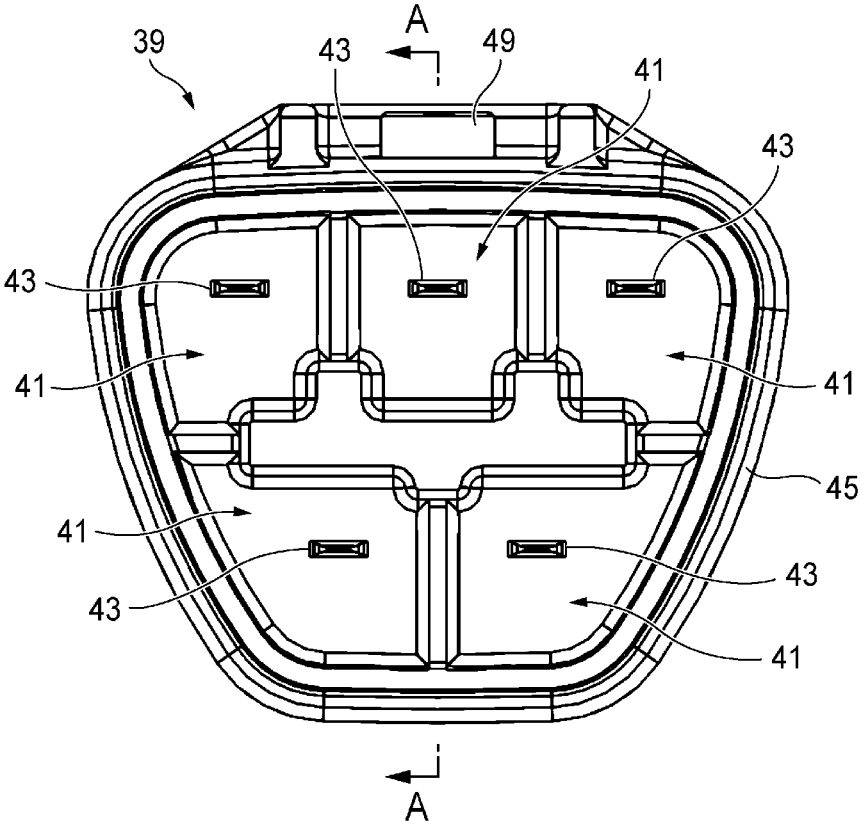
FIG. 4A is a front view illustrating the counterpart connector illustrated in FIG. 3.
Figure 4B:
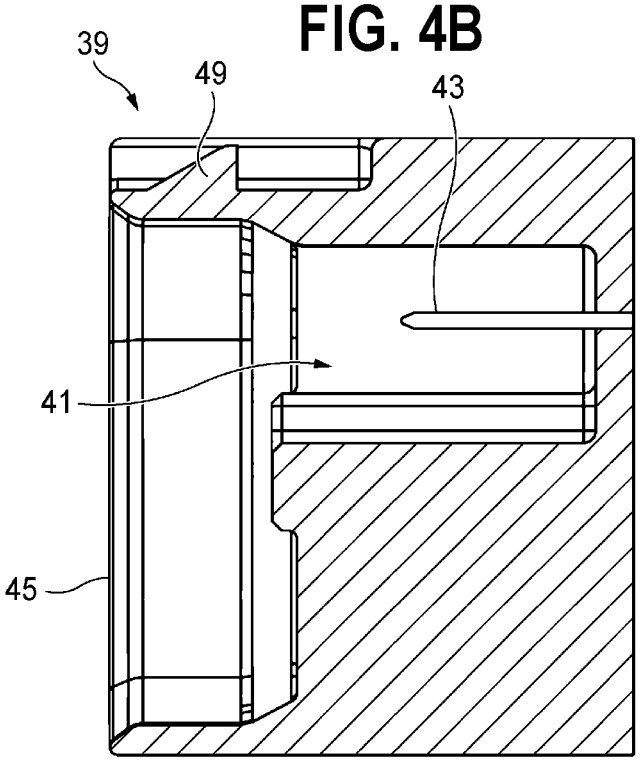
FIG. 4B is a cross-sectional view taken along line A-A in FIG. 4A.

FIG. 3 is a perspective view illustrating a counterpart connector 39, FIG. 4A is a front view illustrating the counterpart connector 39, and FIG. 4B is a cross-sectional view taken along line A-A of FIG. 4A.

The counterpart connector 39 provided in, for example, a fuel tank is fitted to the distal end side of the connector 100 provided in, for example, a wire harness of a floor. The counterpart connector 39 is formed of, for example, resin such as plastic and includes plural (in the embodiment, five) fitting recessed portions 41. A terminal 43 that is a bus bar protrudes from each of the fitting recessed portions 41. In the embodiment, the terminal 43 is a male terminal.

The counterpart connector 39 includes a hood portion 45 that is a cylindrical counterpart fitting portion. A locking protrusion 49 that is locked to a locking portion 47 of the housing 11 protrudes from an outer periphery of the hood portion 45. The above-described fitting recessed portions 41 are disposed inside of the hood portion 45 of the counterpart connector 39. The hood portion 45 enters into the ring-shaped gap 31 of the connector 100. The hood portion 45 in the ring-shaped gap 31 is loosely fitted to the outer periphery of the fitting portion 13 (is fitted in a state where a clearance space is secured). The packing 15 mounted in the fitting portion 13 is interposed between the inner periphery of the hood portion 45 and the outer periphery of the fitting portion 13 (in the clearance space).

Figure 5A:
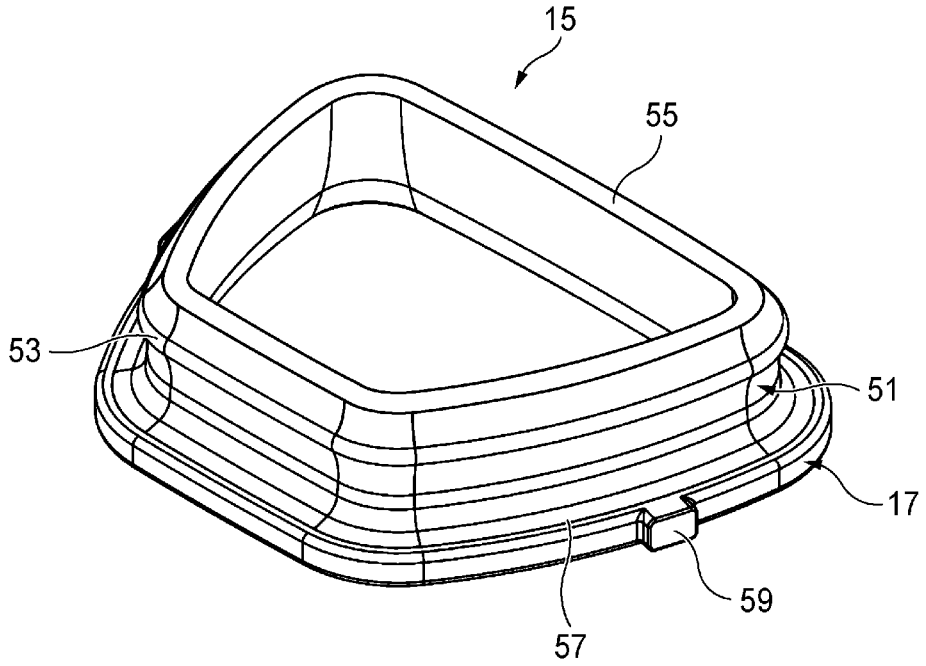
FIG. 5A is a perspective view illustrating a packing illustrated in FIG. 2.
Figure 5B:
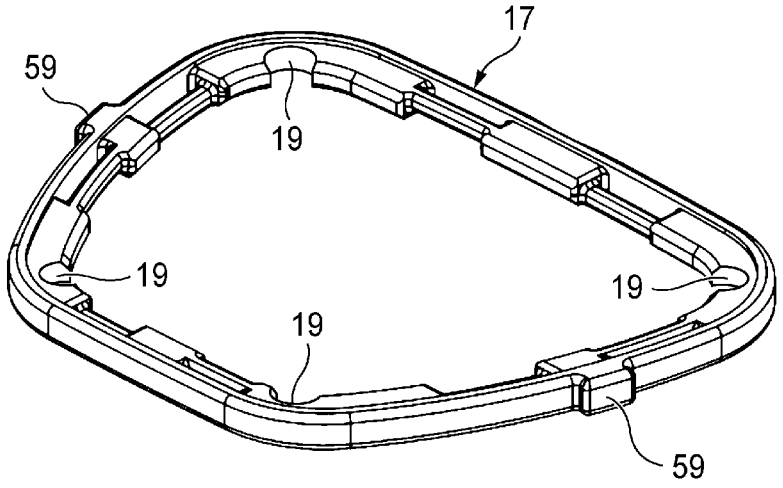
FIG. 5B is a perspective view illustrating a resin ring portion illustrated in FIG. 5A.

FIG. 5A is a perspective view illustrating the packing 15 illustrated in FIG. 2, and FIG. 5B is a perspective view illustrating a resin ring portion 17 illustrated in FIG. 5A.

The packing 15 includes a main body 51 and the resin ring portion 17.

The main body 51 is formed of, for example, a highly flexible material such as rubber and has an inverted trapezoidal ring in a front view. An inner periphery of the main body 51 is externally inserted in a tightly fitted manner to the outer periphery of the fitting portion 13. In the vicinity of a front end portion of the main body 51, a lip portion 53 that protrudes to the outer periphery side in the peripheral direction is provided. The lip portion 53 is provided in order to reliably make the outer peripheral surface of the main body 51 tightly fitted to the inner peripheral surface of the hood portion 45 of the counterpart connector 39. As a result, the packing 15 water-tightly seals a space between the fitting portion 13 of the connector 100 and the hood portion 45 of the counterpart connector 39.

The resin ring portion 17 is formed of, for example, resin such as plastic having a higher rigidity than the main body 51 of the packing 15. Like the main body 51, the resin ring portion 17 is formed in an inverted trapezoidal ring in a front view.

The resin ring portion 17 is provided at a base end 57 of the packing 15 opposite to a distal end 55 where the counterpart connector 39 is fitted, so as to be integrated with the outer periphery of the main body 51 by using an adhesive or integral molding. As a result, in the packing 15, the resin ring portion 17 protrudes in a ring shape from the outer peripheral surface of the main body 51.

In the center portion of opposite side portions of the resin ring portion 17 in the vertical direction, a locking protrusion 59 that protrudes outward is formed. When the packing 15 is inserted into the outer periphery of the fitting portion 13, the locking protrusion 59 is locked to the locking arm 33 that is an engagement portion provided in the housing 11. As a result, the packing 15 is restricted from moving to the distal end side, is restricted from moving to a rear side of an inner wall 61 (refer to FIG. 6) of the ring-shaped gap 31, is retained in the fitting portion 13, and is assembled into the housing 11.

The resin ring portion 17 includes a notch portion 19. The notch portion 19 is formed by outwardly cutting off a part of an inner periphery of the resin ring portion 17. In the embodiment, the notch portion 19 is formed in a substantially semicircular shape. The notch portion 19 may be formed in a triangular shape, a quadrangular shape, or a narrow slit shape.

In the first embodiment, the resin ring portion 17 is formed in a polygonal (inverted trapezoidal in a front view) ring shape as described above. The notch portion 19 is formed in at least one internal corner portion of the resin ring portion 17. In the embodiment, four notch portions 19 in total are provided in all the internal corner portions of the resin ring portion 17, respectively.

Next, the effects of the above-described configuration will be described.

Figure 6:
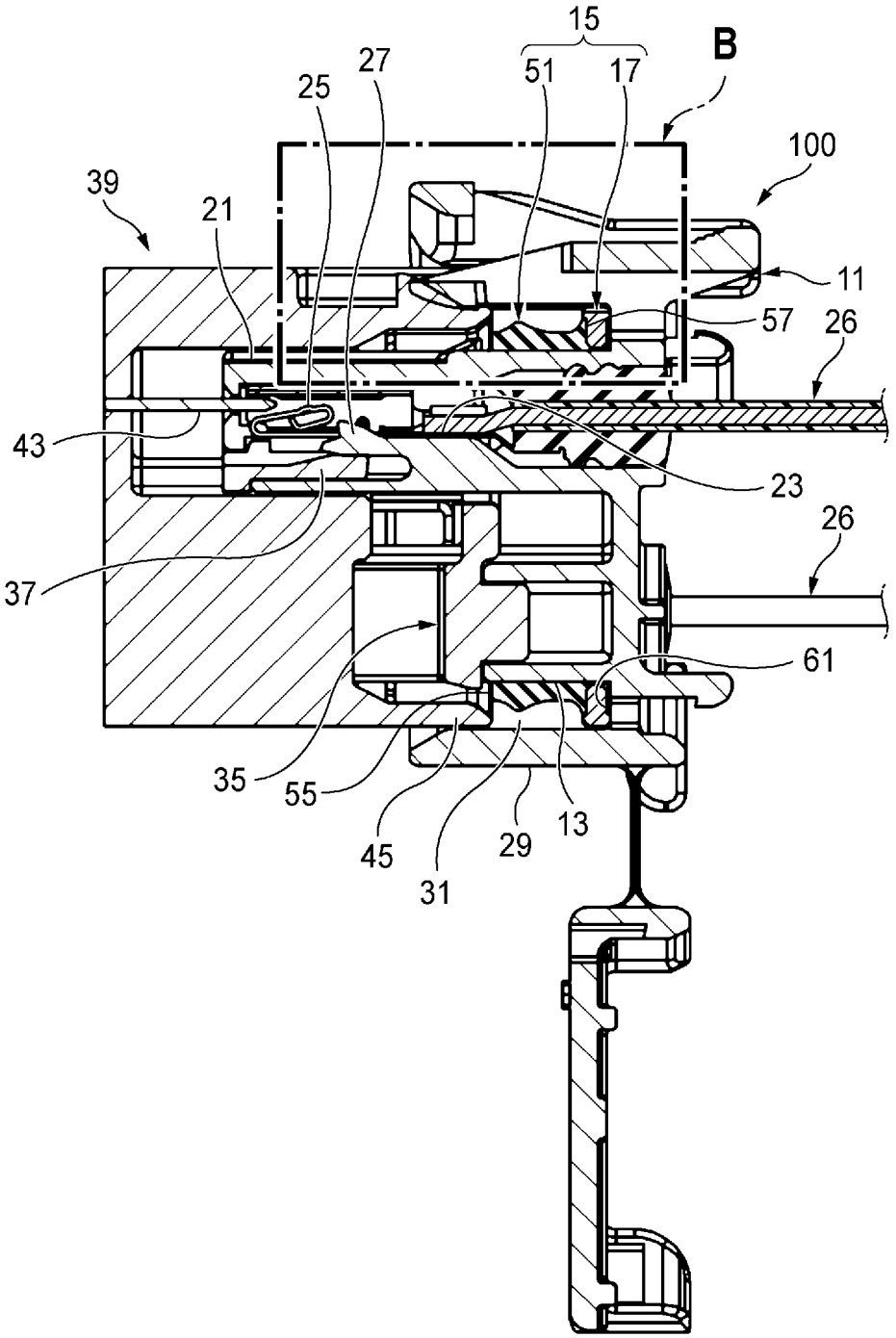
FIG. 6 is a longitudinal sectional view illustrating the connector to which the counterpart connector is being fitted.
Figure 7A:
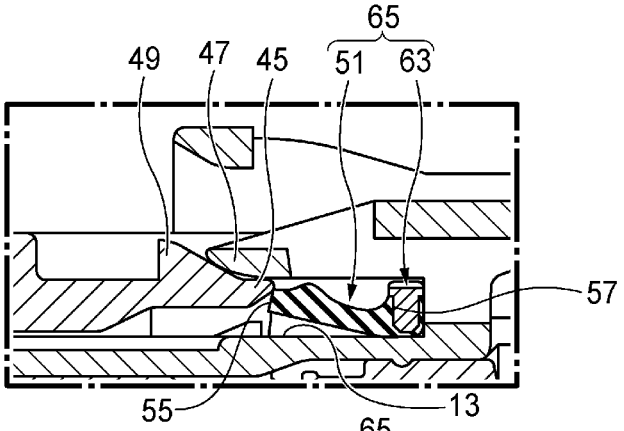
FIG. 7A is an enlarged view illustrating major parts corresponding to a portion B illustrated in FIG. 6 at the start of fitting in a connector according to a comparative example into which a packing where a resin ring portion does not include a notch portion is assembled.
Figure 7B:
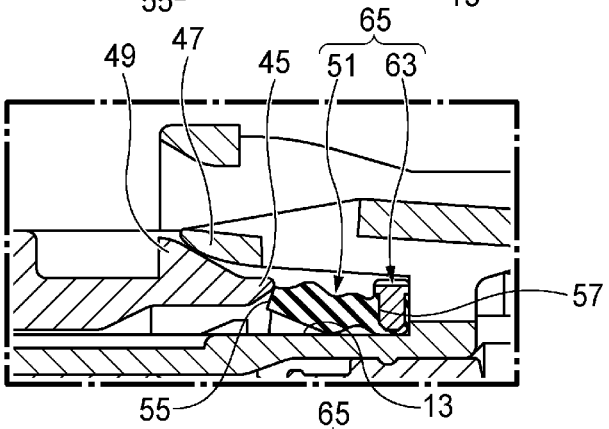
FIG. 7B is an enlarged view illustrating the major parts during the fitting.
Figure 7C:
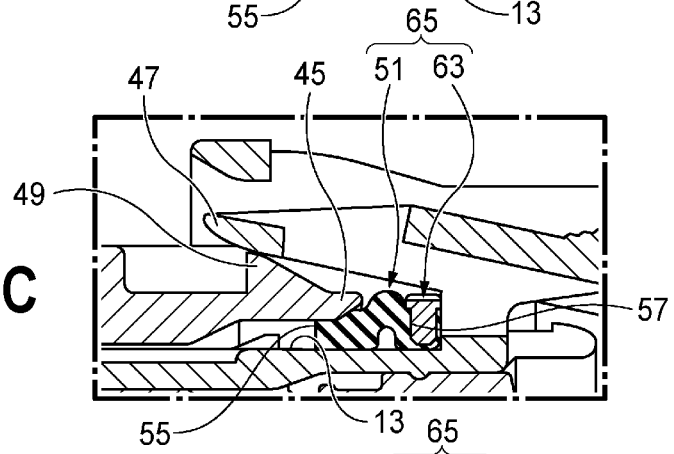
FIG. 7C is an enlarged view illustrating the major parts of the packing that is displaced during the fitting.
Figure 7D:
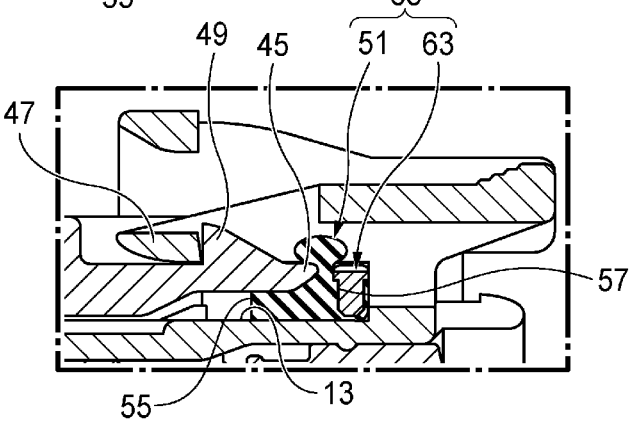
FIG. 7D is an enlarged view illustrating the major parts of the packing that is bitten.

FIG. 6 is a longitudinal sectional view illustrating the connector 100 to which the counterpart connector 39 is being fitted. FIG. 7A is an enlarged view illustrating major parts corresponding to a portion B illustrated in FIG. 6 at the start of fitting in a connector according to a comparative example into which a packing 65 where a resin ring portion 63 does not include the notch portion 19 is assembled, FIG. 7B is an enlarged view illustrating the major parts during the fitting, FIG. 7C is an enlarged view illustrating the major parts of the packing 65 that is displaced during the fitting, and FIG. 7D is an enlarged view illustrating the major parts of the packing 65 that is bitten.

As illustrated in FIG. 6, in the connector 100 according to the first embodiment, the fitting portion 13 is fitted and connected to the hood portion 45 of the counterpart connector 39. As a result, the terminals 25 of the terminal accommodation chambers 21 are electrically connected to the terminals 43 of the counterpart connector 39, respectively.

However, in the connector according to the comparative example including the packing 65 where the resin ring portion 63 does not include the notch portion 19, a distal end 55 of the packing 65 may be raised as illustrated in FIG. 7A.

In a case where the distal end of the main body 51 is deformed to be raised, when the counterpart connector 39 is inserted into the housing 11, the hood portion 45 may come into contact with (abut) the distal end 55 of the main body 51. In this case, as illustrated in FIGS. 7B and 7C, the distal end side of the packing 65 is deformed to be pressed to the rear side. As a result, as illustrated in FIG. 7D, the fitting work is completed in a state where the packing 65 is bitten. The connector in the fitted state cannot satisfy waterproof performance and may have a product defect.

Figure 8A:
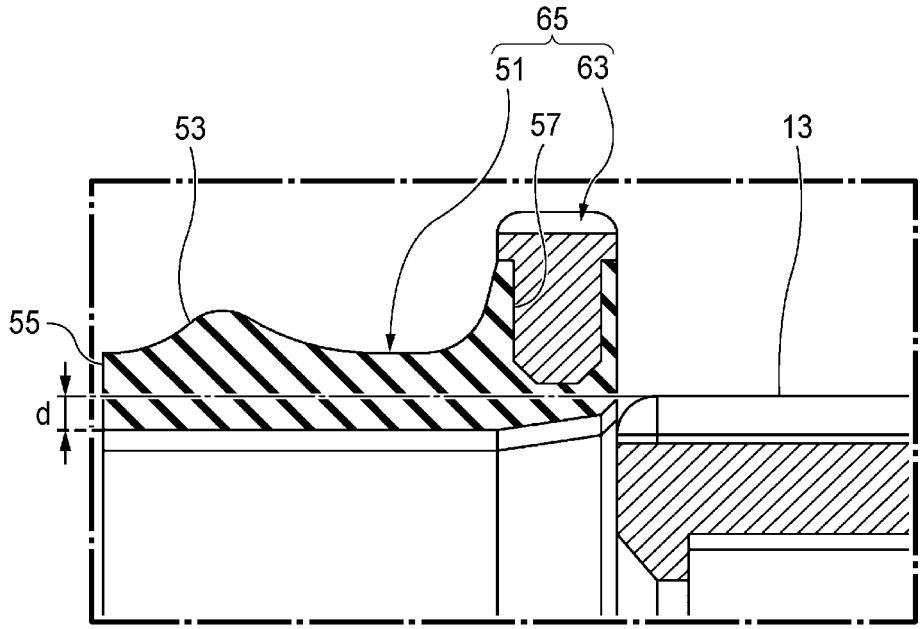
FIG. 8A is a cross-sectional view illustrating major parts to describe a difference between an outer diameter of a fitting portion and an inner diameter of the packing in the connector according to the comparative example of FIGS. 7A to 7D.

FIG. 8A is a cross-sectional view illustrating major parts to describe a difference between an outer diameter of the fitting portion 13 and an inner diameter of the packing 65 in the connector according to the comparative example of FIGS. 7A to 7D, and FIG. 8B is a cross-sectional view illustrating the major parts of the connector according to the comparative example in which the distal end 55 of the packing 65 is raised.

The mechanism for the rising of the packing is presumed to be as follows. That is, as illustrated in FIG. 8A, the inner diameter of the main body 51 of the packing 65 wraps around the outer diameter of the fitting portion 13 by a dimension d such that the main body 51 is tightly fitted to the fitting portion 13. That is, the main body 51 is interferencefitted to the fitting portion 13 (the outer diameter of the fitting portion 13 is larger than the inner diameter of the main body 51).

Figure 8B:
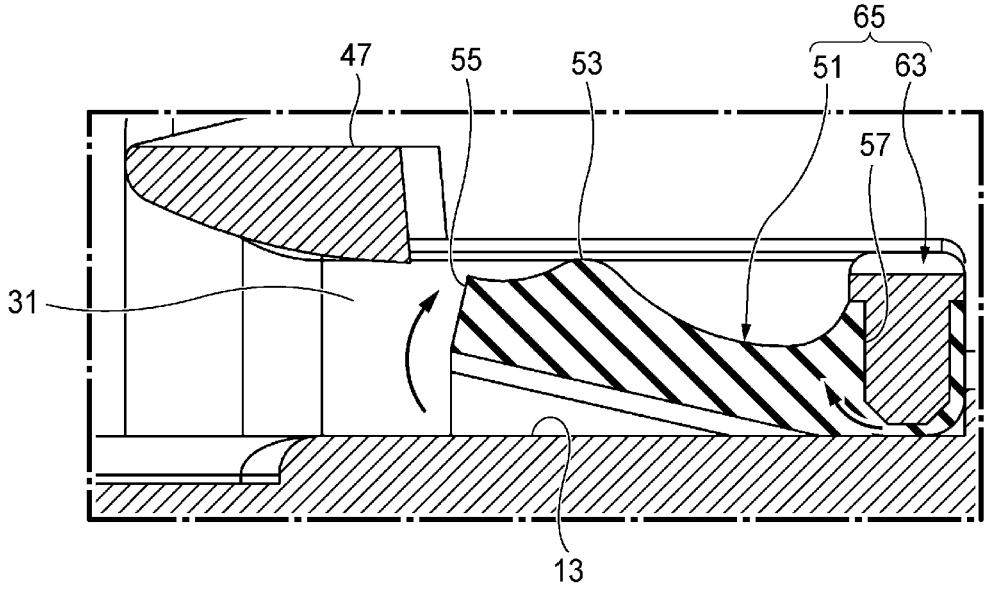
FIG. 8B is a cross-sectional view illustrating the major parts of the connector according to the comparative example in which a distal end of the packing is raised.

As a result, as illustrated in FIG. 8B, when the packing 65 is inserted into the fitting portion 13, the resin ring portion 63 does not move. Therefore, a partial packing material of the main body 51 which is compressed between the resin ring portion 63 and the fitting portion 13 is displaced to the front side. This displacement works as moment that raises the distal end side of the packing 65.

Figure 9:
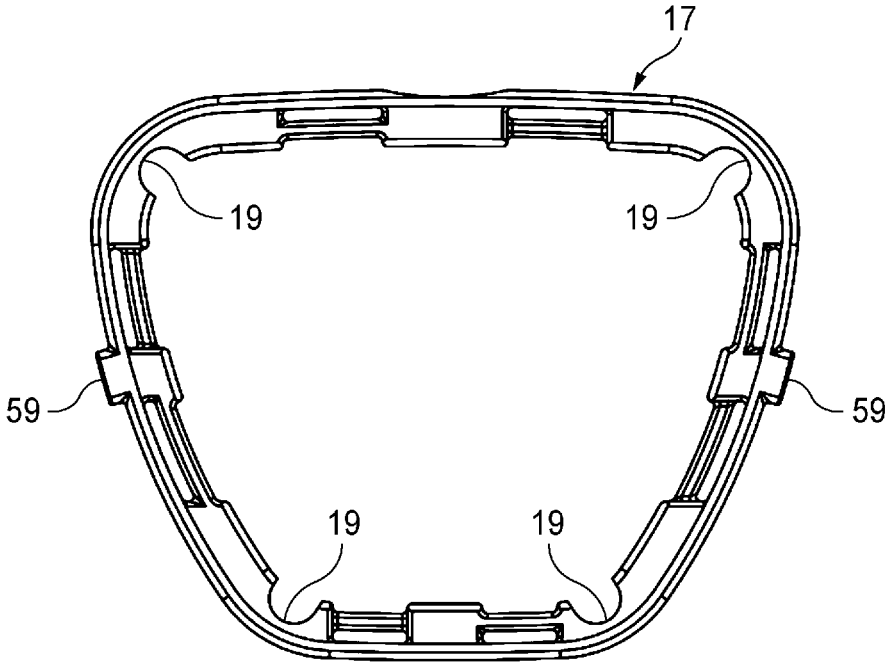
FIG. 9 is a front view illustrating the resin ring portion illustrated in FIG. 5B.

On the other hand, in the connector 100 according to the embodiment, as illustrated in FIG. 9, the notch portions 19 are provided at four internal corner portions of the resin ring portion 17 in the packing 15, respectively. The diameter of the resin ring portion 17 including the notch portion 19 is more likely to increase outwardly than that of the resin ring portion 63 not including the notch portion 19.

In particular, in the packing 15 according to the first embodiment, the notch portion 19 is provided in the internal corner portion of the polygon. As a result, the diameter of the resin ring portion 17 can be effectively increased (are likely to extend) as compared to a case where the notch portion 19 is provided in a side portion of the polygon.

Figure 10A:
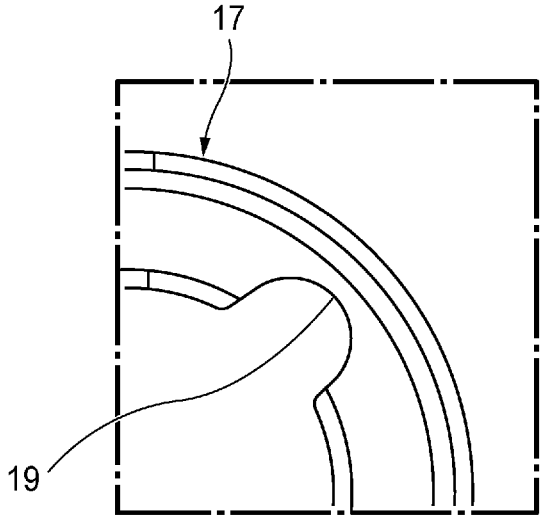
FIG. 10A is an enlarged front view illustrating major parts in the vicinity of the notch portion in the resin ring portion before assembly.
Figure 10B:
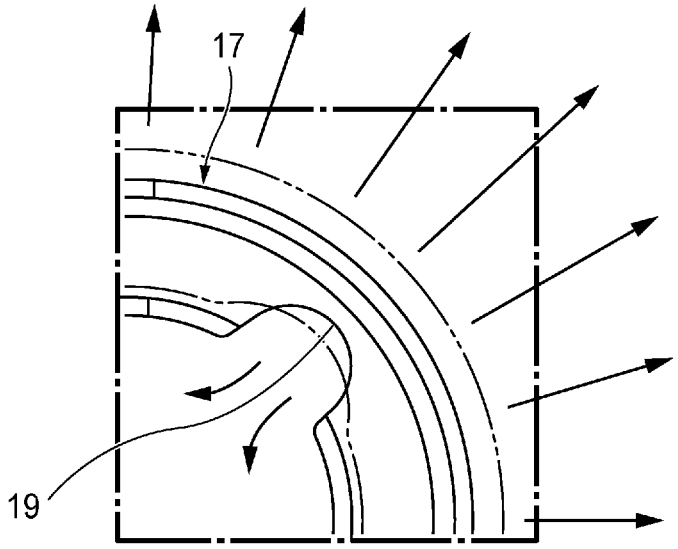
FIG. 10B is an operation explanation view illustrating a displacement in the vicinity of the notch portion after assembly.
Figure 11A:
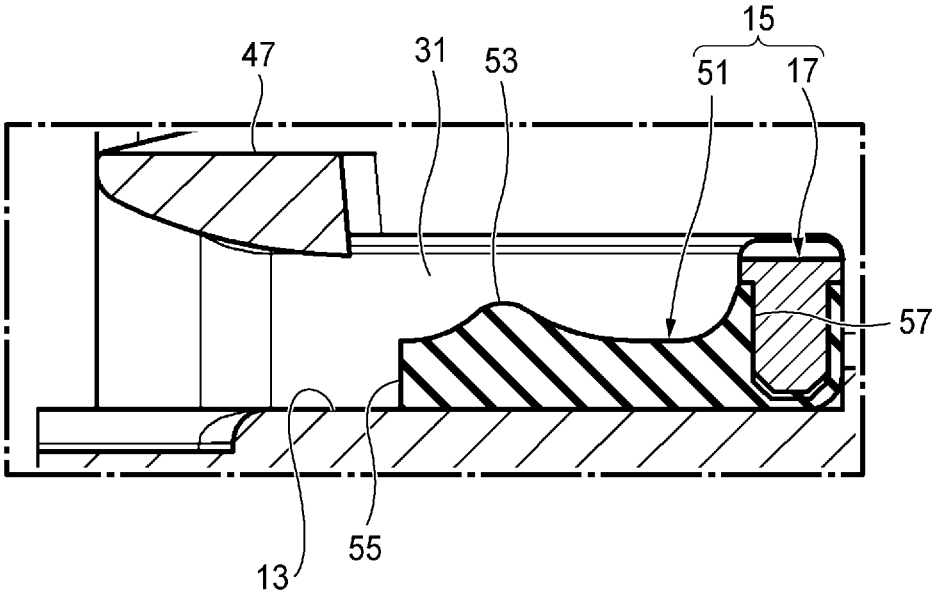
FIG. 11A is a cross-sectional view illustrating major parts of the fitting portion of a housing into which the packing illustrated in FIG. 2 is assembled.
Figure 11B:
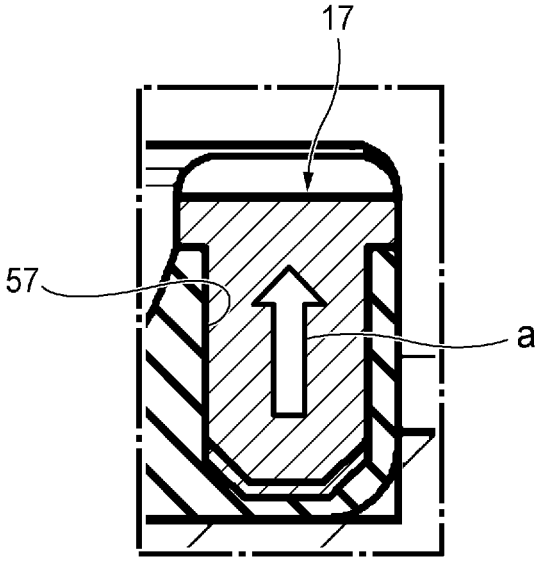
FIG. 11B is an enlarged view illustrating the major parts of FIG. 11A.

FIG. 10A is an enlarged front view illustrating major parts in the vicinity of the notch portion 19 in the resin ring portion 17 before assembly, and FIG. 10B is an operation explanation view illustrating a displacement in the vicinity of the notch portion 19 after assembly. FIG. 11A is a cross-sectional view illustrating major parts of the fitting portion 13 of the housing 11 into which the packing 15 illustrated in FIG. 2 is assembled, and FIG. 11B is an enlarged view illustrating the major parts of FIG. 11A. In the packing 15 according to the first embodiment, the notch portion 19 is provided in a part of the resin ring portion 17 that is locked to the locking arm 33 provided in the housing 11. As a result, the frame strength of the resin ring portion itself (the strength to restrain an increase in the diameter of the main body 51) is weakened. In a case where the packing 15 is mounted in the fitting portion 13 of the housing 11, when the elastic member of the main body 51 is compressed between the resin ring portion 17 and the fitting portion 13, the notch portion 19 extends as illustrated in FIGS. 10A and 10B due to the reaction force, and the resin ring portion 17 extends (the diameter thereof increases) in a direction opposite to a surface thereof tightly fitted with the fitting portion 13.

The direction in which the resin ring portion 17 extends is a direction indicated by an arrow "a" in FIG. 11B. As a result, the amount by which the elastic member of the main body 51 is displaced from the space between the resin ring portion 17 and the fitting portion 13 to the distal end side is suppressed. Accordingly, the rising of the distal end side of the packing 15 is prevented from occurring when the elastic member of the main body 51 moves from the space between the resin ring portion 17 and the fitting portion 13 to the distal end side.

Figure 12A:
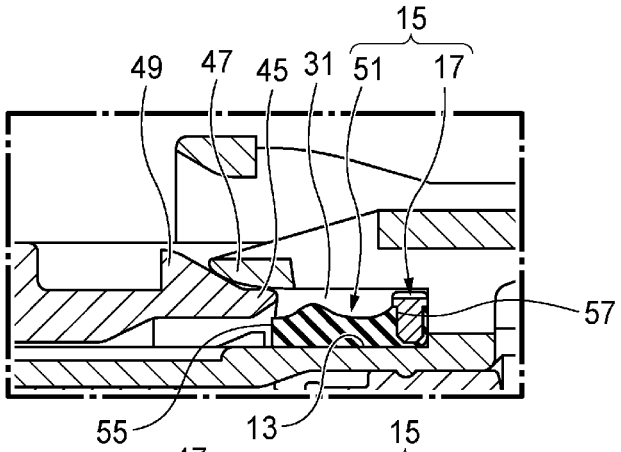
FIG. 12A is an enlarged view illustrating major parts corresponding to a portion B illustrated in FIG. 6 at the start of fitting in the connector into which the packing where the resin ring portion includes the notch portion is assembled.
Figure 12B:
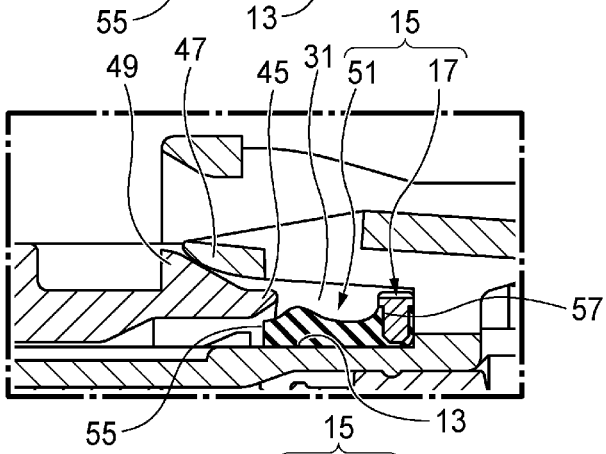
FIG. 12B is an enlarged view illustrating the major parts during the fitting.
Figure 12C:
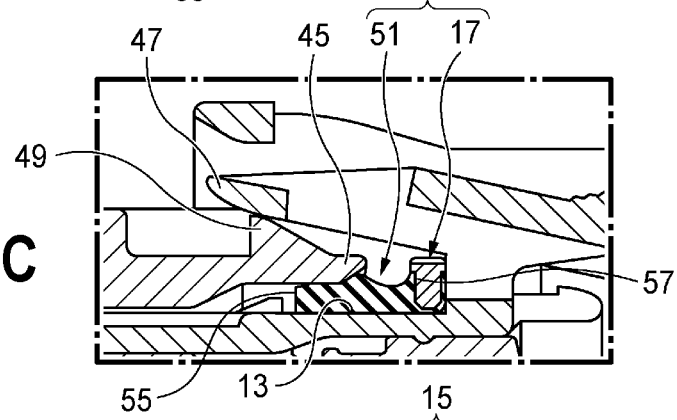
FIG. 12C is an enlarged view illustrating the major parts during the fitting.
Figure 12D:
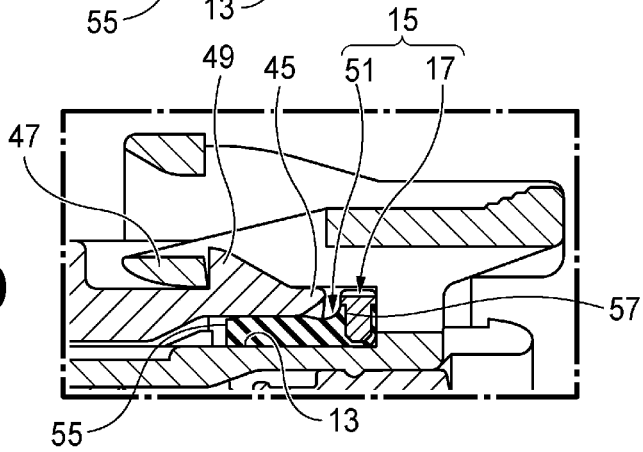
FIG. 12D is an enlarged view illustrating the major parts of the connector in which the fitting work is completed without biting.

FIG. 12A is an enlarged view illustrating major parts corresponding to a portion B illustrated in FIG. 6 at the start of fitting in the connector 100 into which the packing 15 where the resin ring portion 17 includes the notch portion 19 is assembled, FIG. 12B is an enlarged view illustrating the major parts during the fitting, FIG. 12C is an enlarged view illustrating the major parts during the fitting, and FIG. 12D is an enlarged view illustrating the major parts of the connector in which the fitting work is completed without biting.

In the connector 100 in which the rising of the distal end side of the packing is prevented as described above, when the counterpart connector 39 is fitted, the hood portion 45 is inserted into the ring-shaped gap 31 positioned outside the packing 15. Therefore, the outer peripheral surface of the main body 51 in the packing 15 is tightly fitted to the inner peripheral surface of the hood portion 45. In particular, the lip portion 53 that is formed on the outer peripheral surface of the main body 51 is pressed against the hood portion 45 and elastically deformed so as to be tightly fitted to the hood portion 45. As a result, a space between the connector 100 and the counterpart connector 39 is reliably waterproofed.

In the connector 100 in which the packing 15 is assembled into the housing 11 as described above, the distal end side of the main body 51 is restricted from being separated from the fitting portion 13 and raised. As a result, for example, when the counterpart connector 39 is inserted into the housing 11, the counterpart connector 39 does not come into contact with the raised distal end 55 of the main body 51, the main body 51 is not deformed, the fitting between the housing 11 and the counterpart connector 39 is smoothly performed, and a space between the housing 11 and the counterpart connector 39 can be waterproofed.

Second Embodiment

Next, a connector according to a second embodiment of the present invention will be described. In the second embodiment, the same members and portions as those illustrated in FIGS. 1 to 12D are represented by the same reference numerals, and the description thereof will not be repeated.

Figure 13:
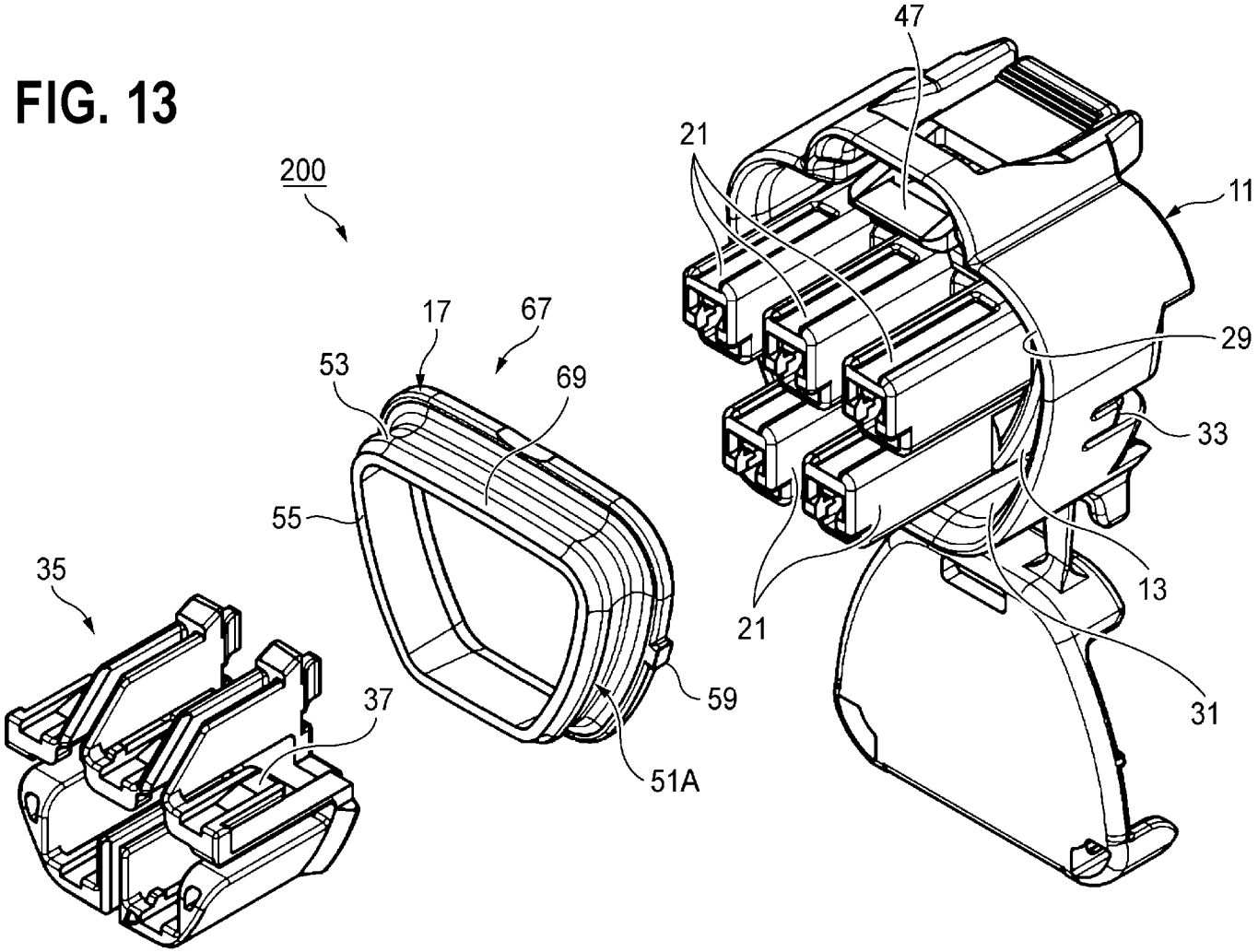
FIG. 13 is an exploded perspective view illustrating a connector according to a second embodiment of the present invention.

FIG. 13 is an exploded perspective view illustrating a connector 200 according to the second embodiment of the present invention.

The connector 200 according to the second embodiment is characterized in that it includes a main body 51A of a packing 67. The other configurations are the same as those of the connector 100 according to the first embodiment.

Figure 14:
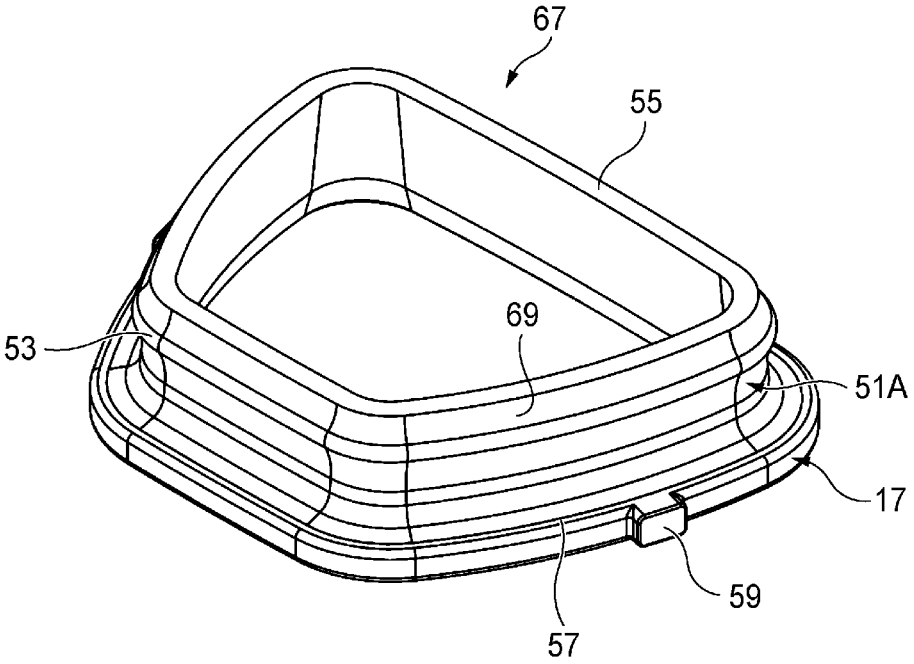
FIG. 14 is a perspective view illustrating a packing illustrated in FIG. 13.

FIG. 14 is a perspective view illustrating the packing 67 illustrated in FIG. 13.

Figure 15C:
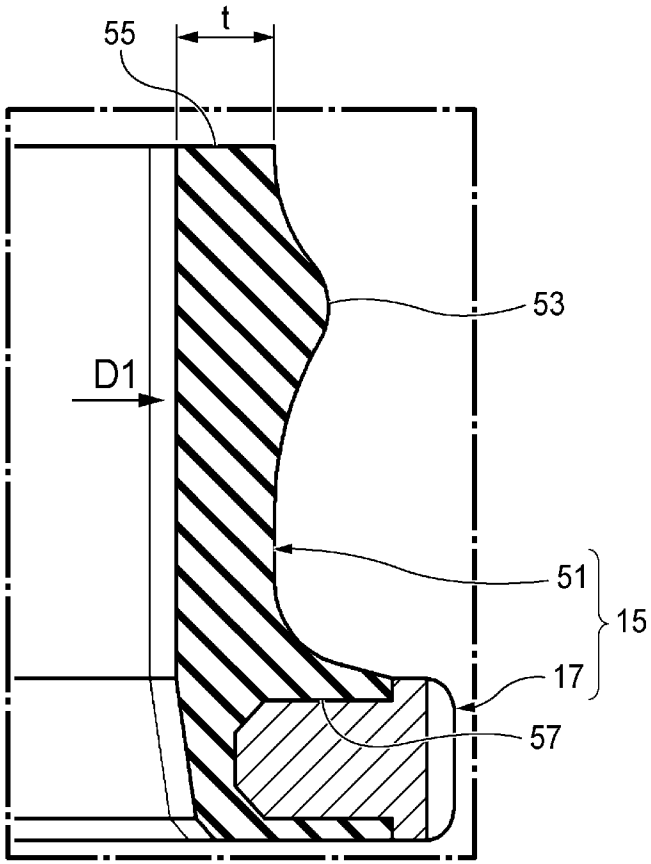
FIG. 15C is an enlarged view illustrating a portion D of FIG. 15B.
Figure 15A:
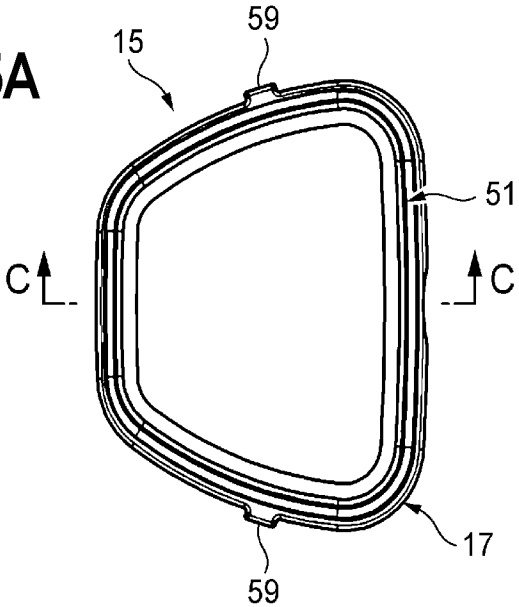
FIG. 15A a front view illustrating the packing according to the first embodiment in which a tapered thick portion is not provided at the distal end.
Figure 15B:
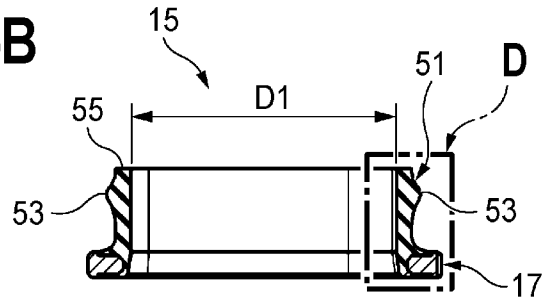
FIG. 15B is a cross-sectional view taken along line C-C of FIG. 15A.

FIG. 15A a front view illustrating the packing 15 according to the first embodiment in which a tapered thick portion 69 is not provided at the distal end 55, FIG. 15B is a cross-sectional view taken along line C-C of FIG. 15A, and FIG. 15C is an enlarged view illustrating a portion D of FIG. 15B. FIG. 16A is a front view illustrating the packing 67 in which the tapered thick portion 69 is provided at the distal end 55, FIG. 16B is a cross-sectional view taken along line E-E of FIG. 16A, and FIG. 16C is an enlarged view illustrating a portion F of FIG. 16B.

In the connector 200 according to the second embodiment, as illustrated in FIG. 14, the distal end 55 of the main body 51A of the packing 67 has smaller inner and outer diameters (inner diameter and outer diameter) than other portions of the main body 51A excluding the distal end and are formed to be thicker than the other portions. As a result, the distal end 55 of the packing 67 forms the tapered thick portion 69.

As illustrated in FIGS. 15A to 15C, in the packing 15 according to the first embodiment in which the tapered thick portion 69 is not provided on the distal end 55, an inner diameter D1 of the inner periphery fitted to the outer periphery of the fitting portion 13 is the same at an arbitrary position on the distal end 55 in an axis direction.

Figure 16C:
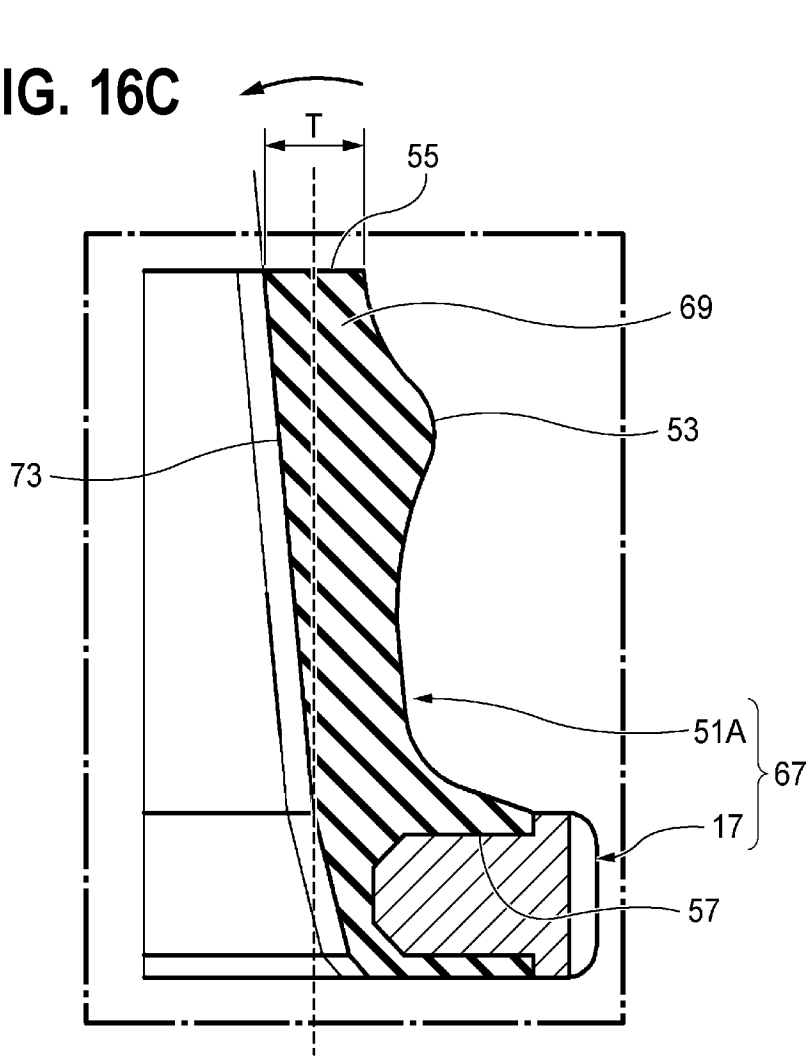
FIG. 16C is an enlarged view illustrating a portion F of FIG. 16B.
Figure 16A:
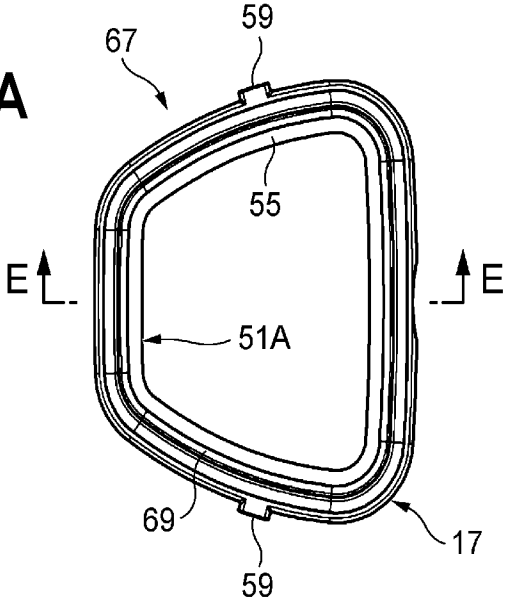
FIG. 16A is a front view illustrating the packing in which the tapered thick portion is provided at the distal end.
Figure 16B:
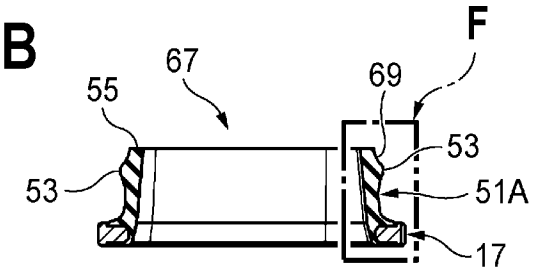
FIG. 16B is a cross-sectional view taken along line E-E of FIG. 16A.

On the other hand, the packing 67 according to the second embodiment in which the tapered thick portion 69 is provided on the distal end 55, as illustrated in FIGS. 16A to 16C, is formed in a tapered shape 73 in which the diameter of the inner periphery fitted to the outer periphery of the fitting portion 13 decreases toward the distal end 55. In addition, a thickness T of the distal end 55 of the packing 67 is larger than a thickness t of the distal end 55 of the packing 15.

Figure 17:
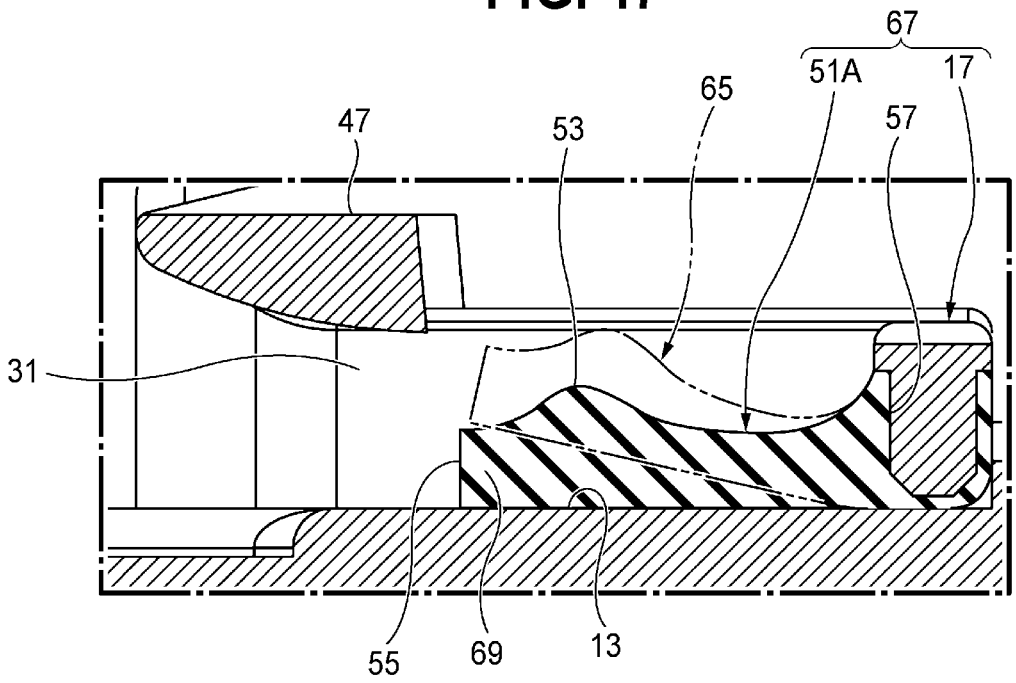
FIG. 17 is a cross-sectional view illustrating major parts of the fitting portion of the housing into which the packing illustrated in FIG. 13 is assembled.

Next, the effects of the above-described configuration will be described. FIG. 17 is a cross-sectional view illustrating major parts of the fitting portion 13 of the housing 11 into which the packing 67 illustrated in FIG. 13 is assembled.

In the connector 200 according to the second embodiment, the tapered thick portion 69 is provided at the distal end 55 of the main body 51A of the packing 67. As a result, in the main body 51A, the rigidity (a characteristic against a force to increase the diameter) of the distal end 55 is higher than the other portions. By providing the tapered thick portion 69 having high rigidity at the distal end 55, when the packing 67 is mounted on the fitting portion 13 of the housing 11, a force (internal tightening force) to tightly fit the packing 67 to the fitting portion 13 is increased. As a result, even when a part of the elastic member of the main body 51A is displaced from the space between the resin ring portion 17 and the fitting portion 13 to the distal end 55, the separation of the distal end side from the outer periphery of the fitting portion 13 is restricted, and the tightly fitted state is maintained. Accordingly, the rising of the distal end side of the packing 67 is further prevented from occurring when the elastic member of the main body 51A moves from the space between the resin ring portion 17 and the fitting portion 13 to the distal end side.

In the connector 200 in which the rising of the distal end side is prevented as described above, when the counterpart connector 39 is fitted as illustrated in FIGS. 12A to 12D, the hood portion 45 is inserted into the ring-shaped gap 31 positioned outside the packing 67. Therefore, the outer peripheral surface of the main body 51 in the packing 67 is tightly fitted to the inner peripheral surface of the hood portion 45. In particular, the lip portion 53 that is formed on the outer peripheral surface of the main body 51 is pressed against the hood portion 45 and elastically deformed so as to be tightly fitted to the hood portion 45. As a result, a space between the connector 200 and the counterpart connector 39 is reliably waterproofed.

In the connector 200 in which the packing 67 is assembled into the housing 11 as described above, the distal end 55 of the main body 51A is restricted from being separated from the fitting portion 13 and raised. As a result, when the counterpart connector 39 is inserted into the housing 11, the counterpart connector 39 does not come into contact with the raised distal end 55 of the main body 51A, the main body 51A is not deformed, the fitting between the housing 11 and the counterpart connector 39 is smoothly performed, and a space between the housing 11 and the counterpart connector 39 can be waterproofed.

Therefore, in the connectors 100 and 200 according to the embodiments, a problem such as biting of the packing during fitting to another connector can be solved, and waterproof performance can be secured without any change in the number of parts and configuration.

the present invention is not limited to the above-described embodiments, and it is apparent that the configurations of the embodiments may be combined, or may be modified and applied by those skilled in the art based on the description of the specification and a known technology, and the combinations, modifications, and applications thereof are within the encompassed scope of the present invention.

In the description of the configuration example of the connector 200 according to the second embodiment, the resin ring portion 17 including the notch portion 19 is used in the packing 67. For example, a connector in which the resin ring portion 63 not including the notch portions 19 is used instead of the resin ring portion 17 of the packing 67 may also be configured. That is, the connector can exhibit the above-described effects only when the packing 67 includes the main body 51A in which the tapered thick portion 69 is provided. However, it is preferable that the connector 200 according to the second embodiment have a configuration in which the packing 67 includes both the notch portion 19 and the tapered thick portion 69. According to this configuration, the rising of the distal end side of the packing in the connector 200 can be more reliably prevented due to the actions of both the notch portion 19 of the resin ring portion 17 and the tapered thick portion 69 of the main body 51A.

Here, the characteristics of the connectors according to the embodiments of the present invention will be collectively summarized in the following [1] to [3].

[1] A connector (100, 200) including:

a housing (11) that includes a fitting portion (13) having an outer periphery to which a cylindrical counterpart fitting portion (hood portion 45) of a counterpart connector (39) is loosely fitted;

a ring-shaped packing (15, 67) including a main body (51, 51A) that is formed of an elastic member and is externally inserted in a tightly fitted manner to the outer periphery of the fitting portion so as to water-tightly seal a space between the fitting portion and the counterpart fitting portion;

a ring-shaped resin ring portion (17) that is provided at a base end (57) of the packing opposite to a distal end (55) where the counterpart connector is fitted, so as to be integrated with an outer periphery of the main body, is formed of resin having a higher rigidity than the main body, and is locked to an engagement portion (locking arm 33) provided in the housing; and a notch portion (19) that is provided in a part of an inner periphery of the resin ring portion.

[2] The connector (100, 200) according to [1], in which the resin ring portion (17) is formed in a polygonal ring shape, and the notch portion (19) is formed in at least one internal corner portion of the resin ring portion.

[3] The connector (200) according to [1] or [2], in which the distal end (55) of the main body (51A) has smaller inner and outer diameters than other portions of the main body excluding the distal end and has a tapered thick portion (69) that is formed to be thicker than the other portions.

What is claimed is:

1. A connector comprising:

a housing that includes a fitting portion having an outer periphery to which a cylindrical counterpart fitting portion of a counterpart connector is loosely fitted;

a ring-shaped packing that includes a main body that is formed of an elastic member and is externally inserted in a tightly fitted manner to the outer periphery of the fitting portion so as to water-tightly seal a space between the fitting portion and the counterpart fitting portion;

a ring-shaped resin ring portion that is provided at a base end of the packing opposite to a distal end where the counterpart connector is fitted, so as to be integrated with an outer periphery of the main body, is formed of resin having a higher rigidity than the main body, and is locked to an engagement portion provided in the housing; and a notch portion that is provided in a part of an inner periphery of the resin ring portion.

2. The connector according to claim 1, wherein the distal end of the main body has smaller inner and outer diameters than other portions of the main body excluding the distal end and has a tapered thick portion that is formed to be thicker than the other portions.

3. The connector according to claim 1, wherein the resin ring portion is formed in a polygonal ring shape, and the notch portion is formed in at least one internal corner portion of the resin ring portion.

4. The connector according to claim 3, wherein the distal end of the main body has smaller inner and outer diameters than other portions of the main body excluding the distal end and has a tapered thick portion that is formed to be thicker than the other portions.

* * * * *